US008824922B2

(12) United States Patent
Suzuki et al.

(10) Patent No.: US 8,824,922 B2
(45) Date of Patent: Sep. 2, 2014

(54) TONER CONTAINER AND IMAGE FORMING APPARATUS

(75) Inventors: Hirokatsu Suzuki, Kanagawa (JP); Kazuaki Kamihara, Tokyo (JP); Yosuke Saito, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 402 days.

(21) Appl. No.: 13/347,208

(22) Filed: Jan. 10, 2012

(65) Prior Publication Data

US 2012/0177406 A1 Jul. 12, 2012

(30) Foreign Application Priority Data

Jan. 11, 2011 (JP) ..... 2011-002713

(51) Int. Cl.
*G03G 15/08* (2006.01)
*G03G 21/00* (2006.01)
*G03G 21/12* (2006.01)

(52) U.S. Cl.
USPC ..... 399/120; 399/358; 399/360

(58) Field of Classification Search
USPC ..... 399/120, 358, 360
See application file for complete search history.

(56) References Cited

U.S. PATENT DOCUMENTS

| | | | | |
|---|---|---|---|---|
| 6,904,249 | B2 * | 6/2005 | Kato et al. | 399/120 |
| 6,934,490 | B2 * | 8/2005 | Koyama et al. | 399/120 |
| 7,917,077 | B2 | 3/2011 | Shimizu et al. | |
| 8,019,254 | B2 | 9/2011 | Tatsumi et al. | |
| 2006/0263116 | A1 * | 11/2006 | Katsuyama | 399/258 |
| 2008/0089727 | A1 | 4/2008 | Shimizu et al. | |
| 2008/0166162 | A1 * | 7/2008 | Hayashi et al. | 399/359 |
| 2008/0181692 | A1 | 7/2008 | Tatsumi et al. | |
| 2008/0267661 | A1 * | 10/2008 | Yoshida et al. | 399/120 |
| 2009/0245863 | A1 * | 10/2009 | Sato et al. | 399/120 |
| 2009/0277911 | A1 | 11/2009 | Koide et al. | |

FOREIGN PATENT DOCUMENTS

| | | | | |
|---|---|---|---|---|
| CN | 101541638 | | 9/2009 | |
| JP | 06-19375 | | 1/1994 | |
| JP | 06-149026 | | 5/1994 | |
| JP | 11153901 | A * | 6/1999 | G03G 15/08 |
| JP | 2001-322687 | | 11/2001 | |
| JP | 2003345116 | A | 12/2003 | |
| JP | 2006-23755 | | 1/2006 | |
| JP | 2008009394 | A | 1/2008 | |
| JP | 2008096810 | A | 4/2008 | |
| JP | 2008116907 | A | 5/2008 | |
| JP | 2008224820 | A * | 9/2008 | |
| JP | 2009042717 | A | 2/2009 | |

OTHER PUBLICATIONS

Chinese Office Action and English translation thereof dated May 21, 2013.
Abstract of JP 2008-009394 published Jan. 17, 2008.
Abstract of JP 2008-116907 published May 22, 2008.
Abstract of JP 2003-345116 published Dec. 3, 2003.
Abstract of JP 2009-042717 published Feb. 26, 2009.
Abstract of JP 2008-096810 published Apr. 24, 2008.

* cited by examiner

*Primary Examiner* — David Bolduc
(74) *Attorney, Agent, or Firm* — Harness, Dickey & Pierce, P.L.C.

(57) ABSTRACT

A toner container removably installed into an image forming apparatus body. The toner container includes a pouch member that contains a new toner therein and can be turned inside out, and a cover member that covers an outside of the pouch member and includes an inlet through which a waste toner flows in, the inlet being formed opposite to a side of the cover member from which the new toner contained in the pouch member is discharged. After the new toner contained in the pouch member is discharged, the pouch member is turned inside out, and the waste toner flows from the inlet into the pouch member.

19 Claims, 7 Drawing Sheets

TONER CONTAINER AND IMAGE FORMING APPARATUS

CROSS-REFERENCE TO RELATED APPLICATIONS

The present application claims priority to and incorporates by reference the entire contents of Japanese Patent Application No. 2011-002713 filed in Japan on Jan. 11, 2011.

BACKGROUND OF THE INVENTION

1. Field of the Invention

The present invention relates to an electrophotographic image forming apparatus, such as a copying machine, a printer, a facsimile, or a combination thereof (e.g. MFP), and a toner container removably installed in the image forming apparatus body.

2. Description of the Related Art

In recent years, a technique has been known in which a toner container (toner cartridge) having a new toner stored therein is configured so as to be removable from an image forming apparatus, such as a copying machine or a printer, and the toner container is also used as a waste toner collecting container for collecting a waste toner (for example, see Japanese Patent Application Laid-open No. 2009-42717 and Japanese Patent Application Laid-open No. 2008-96810).

In Japanese Patent Application Laid-open No. 2009-42717 and Japanese Patent Application Laid-open No. 2008-96810, a toner container (toner cartridge) includes a new toner storage unit for storing a new toner and a waste toner collecting unit for storing a collected waste toner. In addition, the toner storage unit and the waste toner collecting unit are partitioned by a flexible partition member to prevent the mixture between a new toner and a waste toner during the use of the toner container in the image forming apparatus.

In the toner container disclosed in Japanese Patent Application Laid-open No. 2009-42717 and Japanese Patent Application Laid-open No. 2008-96810, a space (waste toner collecting unit) for collecting the waste toner is provided separately from a space (new toner storage unit) for storing the new toner, in advance. Therefore, the waste toner collecting unit increases the whole size of the toner container in comparison with a toner container for storing only the new toner without collecting the waste toner. In addition, the most part of the inner space of the toner container becomes empty after all the new toner is exhausted or consumed. Thus, the space is not used effectively.

Therefore, there is a need to provide a toner container and an image forming apparatus, capable of utilizing the space effectively. This invention has been made in view of the above problems.

SUMMARY OF THE INVENTION

It is an object of the present invention to at least partially solve the problems in the conventional technology.

A toner container removably installed into an image forming apparatus body includes: a pouch member that contains a new toner therein and can be turned inside out; and a cover member that covers an outside of the pouch member and includes an inlet through which a waste toner flows in, the inlet being formed opposite to a side of the cover member from which the new toner contained in the pouch member is discharged. After the new toner contained in the pouch member is discharged, the pouch member is turned inside out, and the waste toner flows from the inlet into the pouch member.

An image forming apparatus includes a toner container removably installed into an image forming apparatus body. The toner container includes: a pouch member that contains a new toner therein and can be turned inside out; and a cover member that covers an outside of the pouch member and includes an inlet through which a waste toner flows in, the inlet being formed opposite to a side of the cover member from which the new toner contained in the pouch member is discharged. After the new toner contained in the pouch member is discharged, the pouch member is turned inside out, and the waste toner flows from the inlet into the pouch member.

The above and other objects, features, advantages and technical and industrial significance of this invention will be better understood by reading the following detailed description of presently preferred embodiments of the invention, when considered in connection with the accompanying drawings.

In the invention, the term "new toner" is defined as toner before it is supplied to an image forming process. Therefore, for example, a recycle toner is also referred to as the "new toner" so long as it has not yet been supplied to a new image forming process.

In addition, the term "waste toner" means toner after it is supplied to the image forming process and is defined so as not to be supplied to the image forming process of the same apparatus body.

The term "toner" is defined so as to include both the "new toner" and the "waste toner".

DETAILED DESCRIPTION OF THE PREFERRED EMBODIMENTS

Figure 1:
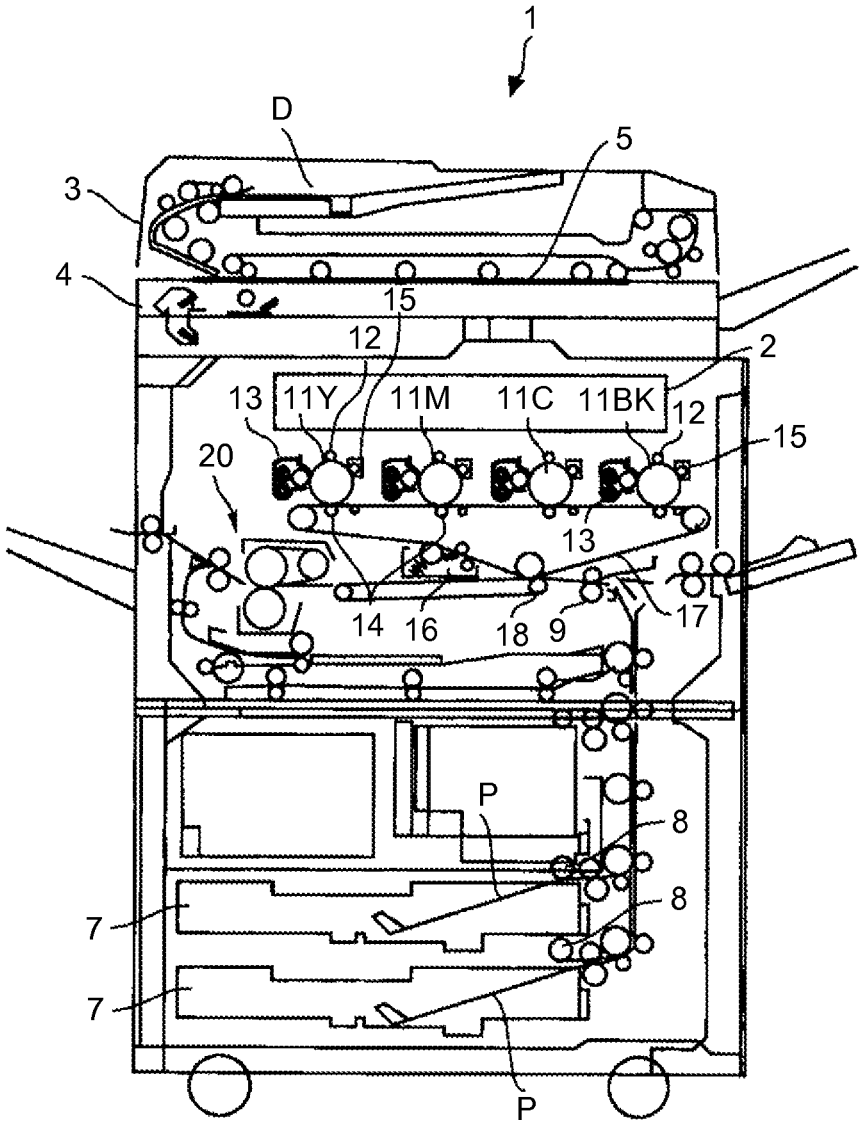
FIG. 1 is a diagram illustrating the overall structure of an image forming apparatus according to a first embodiment.

Hereinafter, exemplary embodiments of the invention will be described in detail with reference to the accompanying drawings. In the drawings, the same or equivalent components are denoted by the same reference numerals and a description thereof will be simplified or will not be repeated.

First Embodiment

A first embodiment of the invention will be described in detail with reference to FIGS. 1 to 3E.

First, the overall structure and operation of an image forming apparatus will be described with reference to FIG. 1.

In FIG. 1, a tandem color copying machine serving as an image forming apparatus includes an apparatus body 1, a writing unit 2 that irradiates a laser beam based on input image information, a document conveying unit 3 that conveys a document D to a document reading unit 4, the document reading unit 4 that reads the image information of the document D, a paper feeding unit 7 that stores a recording medium P, such as a transfer sheet, a registration roller 9 that adjusts the convey timing of the recording medium P, photosensitive drums 11Y, 11M, 11C, and 11BK which serve as image carriers for forming toner images of colors (yellow, magenta, cyan, and black), charging units 12 that charge the surfaces of the photosensitive drums 11Y, 11M, 11C, and 11BK, developing devices 13 that develop electrostatic latent images formed on the photosensitive drums 11Y, 11M, 11C, and 11BK, transfer bias rollers (primary transfer bias rollers) 14 that transfer the toner images formed on the photosensitive drums 11Y, 11M, 11C, and 11BK onto the recording medium P such that the toner images overlap each other, and cleaning units 15 that collect the toner which remains on the photosensitive drums 11Y, 11M, 11C, and 11BK without being transferred.

In addition, the image forming apparatus includes an intermediate transfer belt cleaning unit 16 that cleans an intermediate transfer belt 17, the intermediate transfer belt 17 onto which the toner images of a plurality of colors are transferred so as to overlap each other, a secondary transfer bias roller 18 that transfers the color toner image on the intermediate transfer belt 17 onto the recording medium P, and a fixing device 20 that fixes a non-fixed image on the recording medium P.

Although not illustrated in the drawings, toner containers of each color which supply color (yellow, cyan, magenta, and black) toners to the developing devices 13 are removably (replaceably) installed above the developing devices 13 facing the photosensitive drums 11Y, 11C, 11M, and 11BK. An operation (replacement operation) of installing or removing the toner container 30 into or from the image forming apparatus body 1 is performed by the operator, such as the user, together with an operation of sliding the document conveying unit 3 or the document reading unit 4 in the horizontal direction using a sliding mechanism (not illustrated) such that hopper units 110 (units in which the toner containers 30 are installed (see, for example, FIG. 2)) of each color are exposed from the upper side of the apparatus body 1.

In order to simplify the operation of installing or removing the toner container 30, the apparatus may be arranged such that a unit, such as the document conveying unit 3 or the document reading unit 4, is not disposed above the hopper unit 110 and the hopper unit 110 may be exposed from the upper side of the apparatus body 1 only by an operation of opening an upper cover of the apparatus body 1.

Next, a normal color image forming operation of the image forming apparatus will be described. An image forming process performed on the photosensitive drums 11Y, 11M, 11C, and 11BK will be described with reference to FIG. 2.

Figure 2:
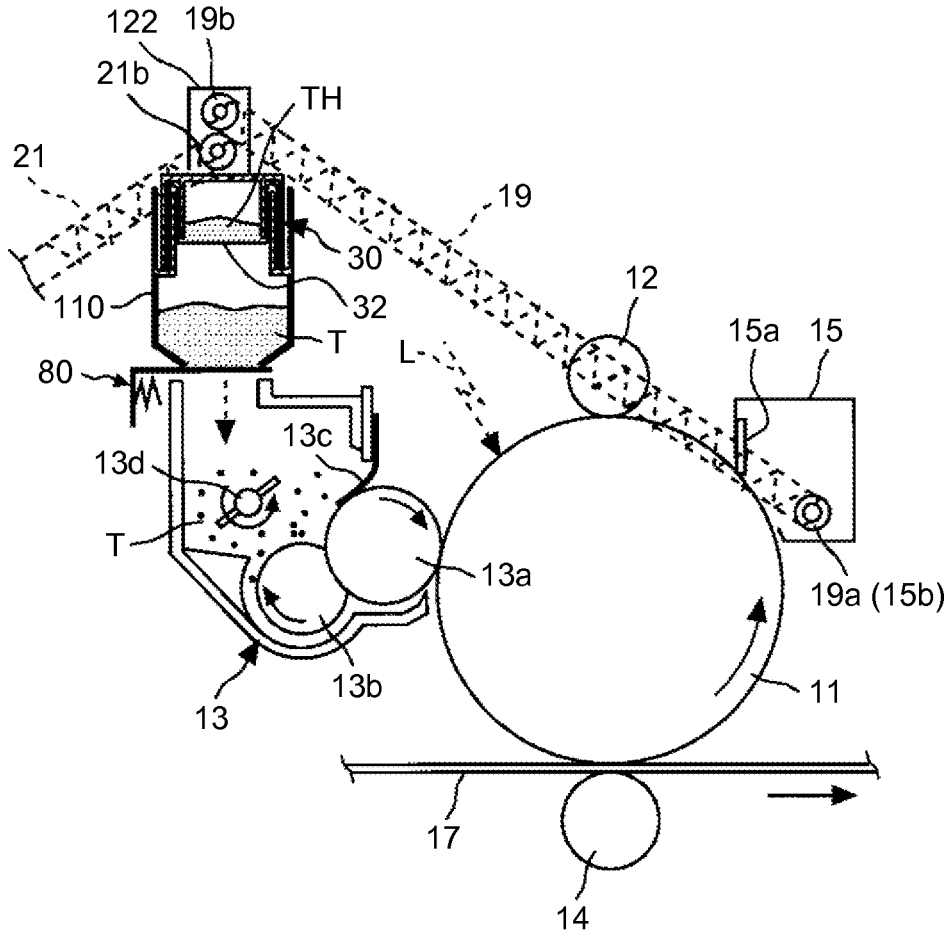
FIG. 2 is a diagram illustrating the structure of an image forming unit of the image forming apparatus.

First, the document D is conveyed from a platen in the direction of an arrow in FIG. 2 by a carriage roller of the document conveying unit 3 and is placed on a contact glass 5 of the document reading unit 4. Then, the document reading unit 4 optically reads the image information of the document D on the contact glass 5.

Specifically, the document reading unit 4 scans the image of the document D on the contact glass 5 while emitting light from an illumination lamp. Then, light reflected from the document D is focused on a color sensor through a mirror group and a lens. The color sensor reads the color image information of the document D for each of RGB (red, green, and blue) color separation light components to convert the color image information into respective electric image signals. An image processing unit performs processes, such as a color conversion process, a color correction process, and a spatial frequency correction process, on the basis of the RGB color separation image signals to obtain yellow, magenta, cyan, and black image information.

The yellow, magenta, cyan, and black image information is transmitted to the writing unit 2. The writing unit 2 emits a laser beam L (see FIG. 2) based on the image information of each color to the corresponding photosensitive drums 11Y, 11M, 11C, and 11BK.

Four photosensitive drums 11Y, 11M, 11C, and 11BK are rotated in the counterclockwise direction of FIG. 1. First, portions of the surfaces of the photosensitive drums 11Y, 11M, 11C, and 11BK facing the charging unit 12 are uniformly charged (charging process). Thus, a charging potential is formed on the photosensitive drums 11Y, 11M, 11C, and 11BK. Then, each of the charged surfaces of the photosensitive drums 11Y, 11M, 11C, and 11BK reaches the positions to which the laser beams are emitted.

In the writing unit 2, four light sources emit the laser beams of each color corresponding to the image signal. The laser beams pass through different optical paths for each color components of yellow, magenta, cyan, and black (exposure process).

The laser beam corresponding to the yellow component is emitted to the surface of the photosensitive drum 11Y, which is illustrated as the leftmost drum in FIG. 1. In this case, the polygon mirror rotating at high speed allows the laser beam corresponding to the yellow component to scan along a rotational axis direction (main scanning direction) of the photosensitive drum 11Y. In this way, after charging process by the charging unit 12, an electrostatic latent image corresponding to the yellow component is formed on the photosensitive drum 11Y.

Similarly, the laser beam corresponding to the magenta component is emitted to the surface of the photosensitive drum 11M, which is illustrated as the second left drum in FIG. 1, to form an electrostatic latent image corresponding to the magenta component. The laser beam corresponding to the cyan component is emitted to the surface of the photosensitive drum 11C, which is illustrated as the second right drum in FIG. 1, to form an electrostatic latent image corresponding to the cyan component. The laser beam corresponding to the black component is emitted to the surface of the photosensitive drum 11BK, which is illustrated as the rightmost drum in FIG. 1, to form an electrostatic latent image corresponding to the black component.

Then, the surfaces of the photosensitive drums 11Y, 11M, 11C, and 11BK having the electrostatic latent images of each color formed thereon reach the positions where they face the developing devices 13. Then, the developing devices 13 supply respective color toners to the photosensitive drums 11Y, 11M, 11C, and 11BK to develop the latent images on the photosensitive drums 11Y, 11M, 11C, and 11BK, respectively (development process).

Then, each of the surfaces of the photosensitive drums 11Y, 11M, 11C, and 11BK after the development process reaches a portion opposite to the intermediate transfer belt 17. In each opposite portion, the transfer bias roller 14 is provided so as to come into contact with the inner circumferential surface of the intermediate transfer belt 17. At the position of the transfer bias roller 14, the toner images of each color formed on the photosensitive drums 11Y, 11M, 11C, and 11BK are successively transferred onto the intermediate transfer belt 17 so as to overlap each other (primary transfer process).

Then, each of the surfaces of the photosensitive drums 11Y, 11M, 11C, and 11BK after the transfer process reaches a position where it faces the cleaning unit 15. Then, the cleaning units 15 collect the toner which remains on the photosensitive drums 11Y, 11M, 11C, and 11BK without being transferred (cleaning process).

Then, the surfaces of the photosensitive drums 11Y, 11M, 11C, and 11BK pass through a neutralization unit (not illustrated) and a series of image forming processes with the photosensitive drums 11Y, 11M, 11C, and 11BK ends.

The intermediate transfer belt 17, onto which the toner images of each color are successively transferred (carried) from the photosensitive drums 11Y, 11M, 11C, and 11BK so as to overlap each other, rotates in the clockwise direction of FIG. 1 and reaches a position where it faces the secondary transfer bias roller 18. Then, the color toner image carried on the intermediate transfer belt 17 is transferred onto the recording medium P at the position facing the secondary transfer bias roller 18 (secondary transfer process).

Then, the surface of the intermediate transfer belt 17 reaches the position of the intermediate transfer belt cleaning unit 16. Then, the intermediate transfer belt cleaning unit 16 collects the non-transferred toner on the intermediate transfer belt 17 and a series of transfer processes with the intermediate transfer belt 17 ends.

The recording medium P, which is conveyed (to a secondary transfer nip) between the intermediate transfer belt 17 and the secondary transfer bias roller 18, is conveyed from the paper feeding unit 7 through the registration roller 9 and the like.

Specifically, the paper feeding unit 7 stores the recording medium P and the recording medium P is fed by a paper feeding roller 8 from the paper feeding unit 7 to the registration roller 9 through a convey guide. The recording medium P reaching the registration roller 9 is conveyed to the secondary transfer nip at an appropriate timing.

Then, the recording medium P having a full color image transferred thereto is guided to the fixing device 20 by a conveying belt. The fixing device 20 fixes the color image to the recording medium P at a nip between a fixing belt and a pressing roller.

Then, the recording medium P after the fixing process is discharged as an output image to the outside of the apparatus body 1 by a discharging roller. In this way, a series of image forming processes ends.

Next, the image forming unit of the image forming apparatus will be described in detail with reference to FIGS. 2 to 3E.

FIG. 2 is a diagram illustrating the structure of the image forming unit and the toner container 30 of the image forming apparatus 1. FIGS. 3A to 3E are diagrams illustrating an operation (process) of installing or removing the toner container 30 into or from the image forming apparatus body 1 and are also diagrams illustrating the structure of the toner container 30 and a main portion of the apparatus body 1.

The image forming units have substantially the same structure and the toner containers have substantially the same structure. Therefore, in FIGS. 2 to 3E, the image forming unit or the toner container is illustrated without the reference alphabet (Y, C, M, and BK) (this holds for FIGS. 4A to 9B in the following second to fourth embodiments).

As illustrated in FIG. 2, the image forming unit includes, for example, the photosensitive drum 11 serving as an image carrier, the charging unit 12, the developing device 13 (developing unit), the cleaning unit 15, and waste toner convey mechanisms 19 and 21.

The photosensitive drum 11 (image carrier) is a negatively charged organic photosensitive element with an outside diameter of about 30 mm and is rotated in the counterclockwise direction by a rotating mechanism (not illustrated).

The charging unit 12 is an elastic charging roller obtained by forming a mid-resistance urethane foam layer in a roller shape around a metal core. The mid-resistance urethane foam layer is made from a urethane resin, a carbon black as conductive particle, a sulfating agent, a foaming agent and the like. The materials for the mid-resistance layer of the charging unit 12 may be a rubber material such as urethane, ethylene-propylene-diene rubber (EPDM), acrylonitrile butadiene rubber (NBR), silicone rubber, isoprene rubber and the like, in which a conductive material such as carbon black or metal oxide is dispersed for controlling the resistance, or foamed materials thereof.

The cleaning unit 15 includes a cleaning blade 15*a* which comes into contact with the photosensitive drum 11 and mechanically removes and collects the non-transferred toner on the photosensitive drum 11. The non-transferred toner collected in the cleaning unit 15 is conveyed from an outlet 15*b* to the inside of the first waste toner convey mechanism 19 by a first convey screw 19*a*. Then, the non-transferred toner is obliquely conveyed to the upper side by a second convey screw provided in a convey pipe of the waste toner convey mechanism 19 and is then collected as a waste toner TH in the toner container 30 by a third convey screw 19*b* through an inlet 31*a* (see FIGS. 3A to 3E).

As such, the toner container 30 according to the first embodiment also functions as a waste toner collecting container, which will be described in detail below.

In the first embodiment, the non-transferred toner is also collected as the waste toner TH in the toner container 30 by the intermediate transfer belt cleaning unit 16 (see FIG. 1).

Specifically, the non-transferred toner collected in the intermediate transfer belt cleaning unit 16 is conveyed to the inside of the second waste toner convey mechanism 21. Then, the non-transferred toner is obliquely conveyed to the upper side by a convey screw provided in a convey pipe of the waste toner convey mechanism 21 and is then collected as the waste toner TH in the toner container 30 by a convey screw 21*b* through an inlet 31*a* (collection hole).

The developing device 13 is arranged such that a developing roller 13*a* comes into contact with the photosensitive drum 11 and a development region (development nip portion) is formed between the two members. A toner T (single-component developer) is stored in the developing device 13. The developing device 13 develops the electrostatic latent image formed on the photosensitive drum 11 (forms a toner image).

Specifically, referring to FIG. 2, the developing device 13 according to the first embodiment is a single-component developing device provided with the developing roller 13*a* (developer carrier), a supply roller 13*b*, a doctor blade 13*c* as a thin film member, a stirring member 13*d*, and the like. The developing device 13 communicates with the hopper unit 110 through a shutter mechanism 80.

The developing device 13 having the above-mentioned structure operates as follows.

First, a portion of the toner which has been supplied from the hopper unit 110 into the developing device 13 through a toner supply hole and then stored in the developing device 13 is carried to the supply roller 13*b*. The toner carried to the supply roller 13*b* is charged by friction in a pressure contact portion with the developing roller 13*a*, is moved onto the developing roller 13*a*, and is carried. Then, the toner carried on the developing roller 13*a* is thinly and uniformly spread at the position of the doctor blade 13*c* and is moved to a contact position (development region) with the photosensitive drum 11. Then, the toner is adsorbed to the latent image formed on the photosensitive drum 11 by the electric field (development electric field) formed in the development region at the contact position.

Figure 3A:
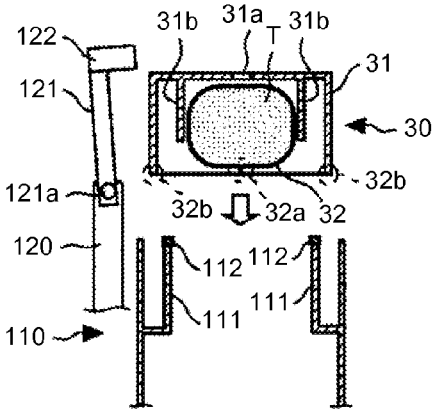
FIGS. 3A to 3E are diagrams illustrating an operation of inserting or removing a toner container into or from an image forming apparatus body.
Figure 3B:
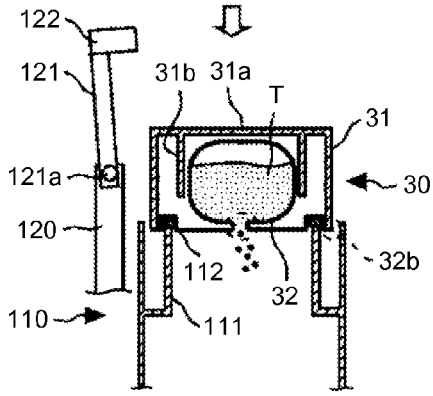
Figure 3C:
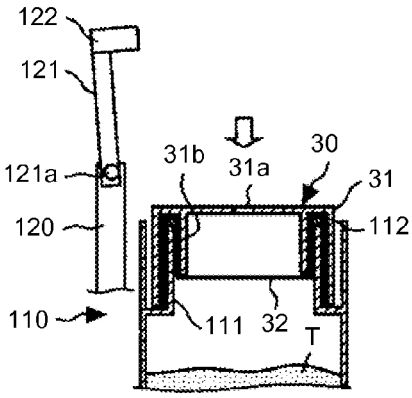
Figure 3D:
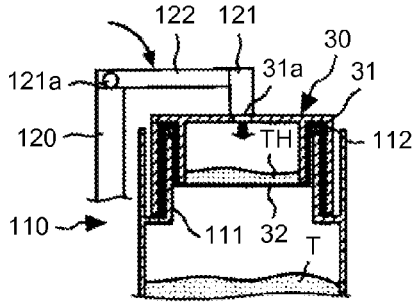
Figure 3E:
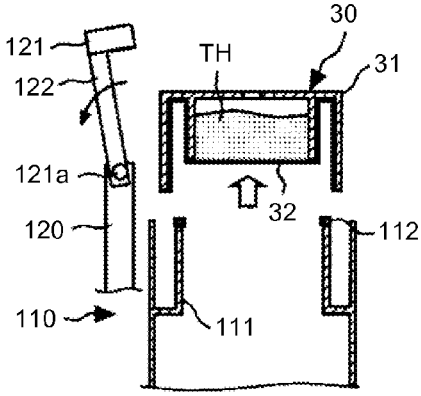

Referring to FIGS. 2 to 3E, a pouch member 32 storing a new toner T (an unused toner before supplied to the image forming process) is provided in a cover member 31 (exterior cover) of the toner container 30.

Referring to FIG. 2, the new toner T stored in the pouch member 32 of the toner container 30 is discharged to the hopper unit 110 in operative association with the installation of the toner container 30 into the hopper unit 110 (apparatus body 1). Then, the new toner T stored in the hopper unit 110 is appropriately supplied from the hopper unit 110 to the developing device 13. Specifically, the shutter mechanism 80 is opened or closed by a shutter driving portion on the basis of the information of the remaining amount of toner detected by a piezoelectric sensor (not illustrated) which is provided in the developing device 13, and the new toner T (toner) is appropriately supplied from the hopper unit 110 into the developing device 13.

In this embodiment, the toner T is supplied on the basis of the information of the remaining amount of toner in the developing device 13, but the invention is not limited thereto. The toner T may be supplied on the basis of the information of image density detected from, for example, the reflectance of the toner image formed on the photosensitive drum 11 or the intermediate transfer belt 17. In addition, the supply of the toner T may be determined on the basis of combinations of these different information items.

In the first embodiment, the inside of the developing device 13 is separated from the hopper unit 110 by the shutter mechanism 80. However, the inside of the developing device 13 and the hopper unit 110 may be integrated into one toner storage unit without being separated by the shutter mechanism 80.

Next, the toner container 30 according to the first embodiment will be described in detail.

Referring to FIG. 3A, the toner container 30 is mainly provided with the pouch member 32 having a new toner T stored therein and the cover member 31 (exterior cover) covering the outside of the pouch member 32.

The cover member 31 is a box-shaped member which is made of a relatively hard resin material (for example, PET or ABS) with a thickness of about 1 mm to 2 mm and has an opening (which is formed in a lower portion in FIG. 3). The inlet 31*a* (through hole) through which the waste toner TH flows is formed at a ceiling portion (an outer wall opposed to the opening) of the cover member 31. That is, in the cover member 31, the inlet 31*a* is formed on a side different from the side from which the new toner stored in the pouch member 32 is discharged (the side where the opening is formed).

In the first embodiment, the cover member 31 includes an inner wall 31*b* (which extends from the ceiling portion to the opening) which is formed so as to extend in parallel to the outer side wall. That is, the inner wall 31*b* rises from the inside of the cover member 31 toward the opening to sandwich the protruding portion (will be described below) of the image forming apparatus body between an outer wall and the inner wall of the cover member when the toner container is installed into the cover member (for example, see FIG. 3C). The pouch member 32 having the new toner T stored therein is provided inside the inner wall 31*b*.

The pouch member 32 is made of a flexible resin material (for example, PE) with a thickness of 1 mm or less and is formed so as to be turned inside out (reversed).

After the new toner T stored in the pouch member 32 is discharged, the inside (inner surface) and the outside (outer surface) of the pouch member 32 are reversed and the waste toner TH flowing from the inlet 31*a* is collected in the inside (the outside when the new toner T is stored) of the pouch member 32. That is, in the apparatus body 1, after the function of the pouch member 32 as a new toner storage pouch storing the new toner T ends, the pouch member 32 is turned inside out and functions as a waste toner collecting pouch that collects the waste toner TH.

Referring to FIG. 3A, a boundary portion 32*b* (an opening portion of the pouch) between the inside and the outside of the pouch member 32 is fixed in the circumference of the opening of the cover member 31 by, for example, thermal welding.

Referring to FIG. 3A, furthermore, the pouch member 32 in a state that the new toner T is contained therein is sealed at a joint portion 32*a* to form a closed space for accommodating the new toner therein. The joint portion 32*a* is formed at a center of the opening separated from the boundary portion 32*b*. Specifically, the joint portion 32*a* is formed by slightly sealing (by thermal welding or the like) a bottom portion of the pouch member 32 just below the opening while squeezing the bottom portion to be sealed. In this context, the "slightly sealing" means a sealing extent capable of containing the new toner therein without leakage when sealed, but capable of releasing the new toner contained therein once an external force more than a predetermined threshold is applied to the joint portion to break the sealing.

In operative association with the installation of the toner container to the image forming apparatus body 1, the inside and the outside of the pouch member 32 is turned over, while the new toner contained in the pouch member 32 is discharged. Specifically, a portion between the boundary portion 32*b* and the joint portion 32*a* of the pouch member 32 is pressed and moved by the protruding portion 111 of the hopper unit 110, in operative association with the inserting movement of the toner container 30 into the hopper unit 100 (the image forming apparatus body 1). At this time, the sealing of the joint portion 32*a* is unsealed to discharge the new toner T contained in the closed space, while the pouch member 32 deforms so that the inside of the pouch member 32 which was the outside when contains the new toner is opposed to the inlet 31*a*.

The protruding portion 111 of the hopper unit 110 is configured to be inserted between the outer wall and the inner wall 31*b* of the cover member 31, with respect to the toner container 30 which is to be installed so as to fit into the inside of the hopper unit 110. Furthermore, in the first embodiment, a heater 112 (heating unit) is disposed at the leading end of the protruding portion 111, which will be described later.

Next, an operation of inserting (installing) or removing the toner container 30 into or from the hopper unit 110 (image forming apparatus body 1) will be described in detail with reference to FIGS. 3A to 3E.

First, as illustrated in FIG. 3A, the operator, such as the user, starts an operation of inserting the toner container 30 in which the new toner T is stored in the pouch member 32 into the hopper unit 110 of the apparatus body 1 from the upper side (the toner container 30 is moved in the direction of a white arrow).

In this case, a relay unit 122 (provided at the apparatus body 1) for supplying the waste toner TH to the toner container 30 (pouch member 32) is moved (retreated) to a position where the insertion of the toner container 30 into the hopper unit 110 is not hindered. The relay unit 122 is a portion of the convey path of the convey screws 19*b* and 21*b* of the waste toner convey mechanisms 19 and 21 which have been described with reference to FIG. 2 and is disposed above the toner container 30. The relay unit 122 is fixed at the leading end of an arm unit 121, which is arranged rotatably around a supporting shaft 121*a* with respect to a support 120. Thereby, the relay unit 122 rotates together with the arm unit 121 to move between a supply position (position illustrated in FIG. 3D) for supplying the waste toner TH to the toner container 30 (pouch member 32) and a retreated position (position illustrated in FIG. 3A) where the insertion of the toner container 30 into the hopper unit 110 is not hindered.

Then, as illustrated in FIG. 3B, when the toner container 30 moves to the hopper unit 110 from the upper side, a portion of the pouch member 32 (tensioned portion disposed at the opening) contacts with and is pressed by the protruding portion 111 of the hopper unit 110. Then, a force acts to unseal or open the sealing of the joint portion 32*a* (a portion circled by a dashed line) to discharge the new toner T by own weight from the inside of the pouch member to the hopper unit 110.

As illustrated in FIG. 3C, the operation of inserting the toner container 30 to the lower side is progressed and the position of the toner container 30 relative to the hopper unit 110 is settled in a state that the outer wall of the cover member 31 contacts with a stopper portion (a horizontal portion connected to the base portion of the protruding portion 111) of the hopper unit 110. In this case, all of the new toner T in the pouch member 32 is discharged to the hopper unit 110 when the pouch member 32 is spread and opened together with the operation of inserting the toner container 30 to the lower side. In a state that the new toner T is discharged, the inside (inner surface) and the outside (outer surface) of the pouch member 32 is completely reversed so as to cover the ceiling portion having the inlet 31*a* formed therein inside the cover member 31.

Then, as illustrated in FIG. 3D, through the rotation of the arm unit 121, the relay unit 122 is set to the supply position where it communicates with the inlet 31*a* of the toner container 30 (cover member 31). The waste toner TH is gradually conveyed (collected) from the waste toner convey mechanisms 19 and 21 to the inside of the pouch member 32 which is turned inside out (the waste toner TH flows in the direction of a black arrow).

Then, as illustrated in FIG. 3E, when the amount of waste toner TH collected in the toner container 30 (pouch member 32) is equal to or more than a predetermined value (the waste toner is full or nearly full), the arm unit 121 is rotated to move the relay unit 122 to the retreated position and the operator removes the toner container 30 from the hopper unit 110 (apparatus body 1) (the toner container 30 is moved in the direction of a white arrow).

The full state of the waste toner TH in the pouch member 32 can be detected by a full level detection sensor, such as a piezoelectric sensor that is provided in the ceiling portion of the inner wall 31*b* and detects whether there is a toner.

The arm unit 121 (relay unit 122) may be configured so as to be manually rotated in operative association with an operation of opening or closing an openable door (not illustrated) of the apparatus body 1.

In addition, a driving motor (not illustrated) for rotating the arm unit 121 may be provided to automatically rotate the arm unit 121. In this case, a set detection sensor that detects the completion of the installation of the toner container 30 into the hopper unit 110 may be provided and the arm unit 121 (relay unit 122) may be rotated from the retreated position on the basis of the detection result of the set detection sensor. In addition, a piezoelectric sensor (full level detection sensor) that detects whether the waste toner TH is full in the toner container 30 may be provided and the arm unit 121 may be rotated from the retreated position on the basis of the detection result of the piezoelectric sensor.

As such, in the first embodiment, in the toner container 30, the pouch member 32 having a new toner T stored therein is provided at the cover member 31 and the pouch member 32 is turned inside out to collect the waste toner TH after the new toner T is discharged. Therefore, in a new toner container, it is not necessary to set a space for collecting a waste toner in advance, separately from a space for storing a new toner. Thereby, an increase in the size of the toner container corresponding to the space for collecting the waste toner can be avoided. In addition, after the new toner T is discharged (consumed), the pouch member 32 can be used as a waste toner collecting pouch. Therefore, the space of the toner container 30 can be effectively used.

In the first embodiment, as described above, the inner wall 31*b* is formed at the cover member 31 of the toner container 30 such that the protruding portion 111 is interposed between the outer wall and the inner wall 31*b* when the protruding portion 111 of the hopper unit 110 is inserted therebetween. As illustrated in FIG. 3C, the inner wall 31*b* configured as such defines the shape of the reversed pouch member 32 when set at the hopper unit 110. That is, the reversed pouch member 32 has a shape uniformly spread downward from the ceiling portion without being non-uniformly shrunken. Thereby, it is possible to prevent or reduce the clogging of the inlet 31*a* due to the deposition of the waste toner TH flowing from the inlet 31*a*.

In the first embodiment, the heater 112 serving as a heating unit is provided at the leading end of the protruding portion 111 of the hopper unit 110 (apparatus body 1). The pouch member 32 is thermally welded to the cover member 31 by the heater 112 (heating unit) at a predetermined timing, in a state that the pouch member 32 is turned inside out so that the inner surface of the pouch member 32 faces the inlet 31*a*, as illustrated in FIG. 3C. Thereby, the pouch member 32 maintains its shape in a state that it is housed in the cover member 31, without elongating downward from the boundary portion 32*b* as a supporting portion, even after the toner container 30 is removed from the hopper unit 110 and the restriction (pushing force) by the protruding portion 111 is released, as illustrated in FIG. 3E.

The thermal welding of the pouch member 32 to the cover member 31 by the heater 112 (heating unit) may be performed at a timing when the insertion (installation) of the toner container into the hopper unit 110 (apparatus body 1) is completed or a timing when the amount of waste toner TH collected in the pouch member 32 reaches a predetermined value. In addition, the above-mentioned set detection sensor or full level detection sensor may be used to detect the timings.

The heater 112 is connected to a power supply unit (not illustrated) provided at the hopper unit 110, so that power is supplied to the heater 112 from the power supply unit at the above-mentioned timing to perform the thermal welding.

As explained above, the toner container 30 according to the first embodiment is configured to collect the waste toner TH after the new toner H is discharged by disposing the pouch member 32 containing the new toner T therein inside the cover member 31, and reversing the pouch member 32 after the new toner T is discharged from the pouch member 32.

Owing to this configuration, it is possible to utilize the space of the toner container 30 effectively.

Second Embodiment

Next, a second embodiment will be described in detail with reference to FIGS. 4A to 4D.

FIGS. 4A to 4D are diagrams illustrating an operation of inserting or removing a toner container 30 according to the second embodiment, similarly to FIGS. 3A to 3E in the first embodiment.

The toner container 30 according to the second embodiment mainly differs from the toner container according to the first embodiment in that the pouch member 32 having a waste toner collected therein is thermally welded by a rotatable protruding portion 111 while forming a closed space and a plate member 35 is provided at the pouch member 32.

Figure 4A:
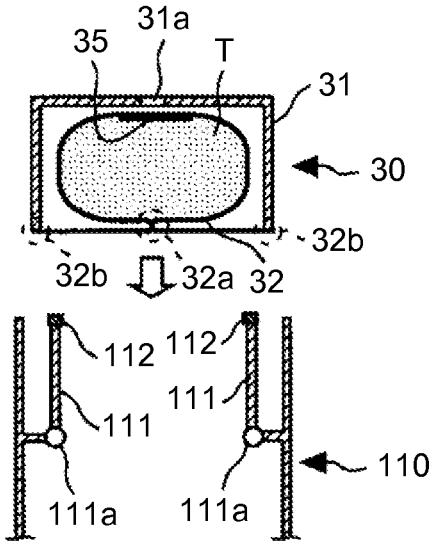
FIGS. 4A to 4D are diagrams illustrating an operation of inserting or removing a toner container according to a second embodiment.

Referring to FIG. 4A, similarly to the toner container according to the first embodiment, the toner container 30 according to the second embodiment is provided with the pouch member 32 and the cover member 31. Similarly to the first embodiment, the pouch member 32 contains the new toner T in a closed space formed by sealing the joint portion 32*a*. The cover member 31 is for covering the outside of the pouch member 32 as an exterior cover, and has the inlet 31*a* at the ceiling portion thereof. Also in the second embodiment, the pouch member 32 is fixed to the cover member 31 at the boundary portions 32*b*. Specifically, the boundary portion 32*b* (opening edge) of the pouch member 32 is fixed at the periphery of the opening of the cover member 31. And, the pouch member 32 can be reversed (turned inside out) to also act as a waste toner collecting unit.

Furthermore, also in the second embodiment, the hopper unit 110 of the apparatus body 1 is provided with the protrusion portions 111. And the heaters 112 (heating units) are provided at the leading end of the protrusion portions 111.

According to the second embodiment, different form the first embodiment, the protruding portions 111 of the hopper unit 110 are configured to pivotally move in such a manner that the leading ends thereof move inward (toward the inside of the cover member 31 in a state that the toner container 30 is installed). Specifically, the base portions 111*a* of the protruding portions 111 are pivot points so that the protruding portions 111 can be moved by a driving motor (not illustrated) in directions as illustrated by arrows in FIGS. 3C and 3D, with respect to the main structure of the hopper unit 110.

The pouch member 32 of the toner container 30 is reversed (i.e. the inner surface and the outer surface thereof are turned inside out) so that the inner surface thereof faces the inlet 31*a* after discharging the new toner T. In this state, a predetermined amount of waste toner TH is collected. After that, the protruding portions 111 pivotally move to form a closed space in which the waste toner TH is contained. The closed space is thermally welded by the heater 112.

Next, the operation of inserting (installing) or removing the toner container 30 into or from the hopper unit 110 (image forming apparatus body 1) will be described in detail with reference to FIGS. 4A to 4D.

First, as illustrated in FIG. 4A, the installation of the toner container 30 housing the pouch member 32 containing the new toner T therein is started toward the hopper unit 110 of the apparatus body 1 from the upper side (to the direction illustrated by a white arrow). Incidentally, the relay unit 122 (the arm unit 121) which moves between the retreated position and the supply position is not illustrated in FIGS. 4A to 4D. This is the same for FIGS. 5A to 9B relating to the third and fourth embodiments.

Figure 4B:
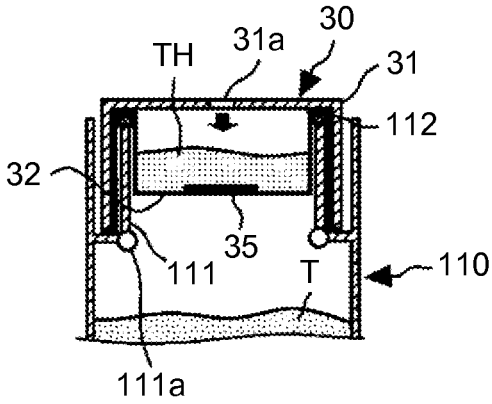

Then, as illustrated in FIG. 4B, similarly to the first embodiment, the installation of the toner container 30 proceeds downward until the position of the toner container 30 is settled with respect to the hopper unit 110 and the pouch member 32 is reversed. After settled and reversed, the waste toner TH flows into the pouch member 32. At this time, similarly to the first embodiment, the pouch member 32 is thermally welded to the cover member 31 by the heater 112 at the portions of the pouch member 32 which contact with the ceiling of the cover member 31.

Figure 4C:
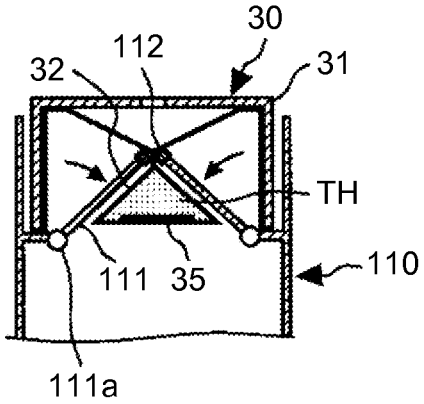

Then, as illustrated in FIG. 4C, when the amount of waste toner TH collected in the toner container 30 (pouch member 32) is equal to or more than a predetermined value (a full state or a near-full state), the protruding portions 111 are pivotally moved to a position where the leading ends (heaters 112) thereof contact each other by a driving motor (not illustrated). In this case, an upper part of the pouch member 32 is interposed and narrowed between the heaters 112 of the protruding portions 11 to form a closed space in which the waste toner TH is collected. Then, in this state, the narrowed portion of the pouch member 32 is thermal welded (sealed) by the heaters 112 supplied with power from a power supply unit (not illustrated).

Figure 4D:
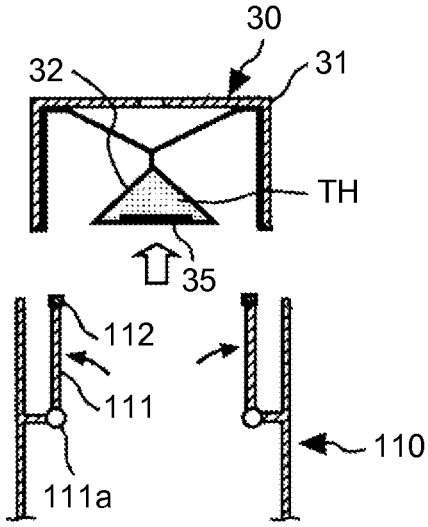

Then, as illustrated in FIG. 4D, the operator removes, from the hopper unit 110 (apparatus body 1), the toner container 30 in which the closed space is formed by the pouch member 32 which has the waste toner TH collected therein and is isolated from the cover member 31 (the toner container 30 is moved to the direction as illustrated by a white arrow). In this case, the protruding portions 111 are pivotally moved to home positions (positions illustrated in FIG. 4A or 4D) by a driving motor (not illustrated) so as not to hinder an operation of removing the toner container 30.

The full state of the waste toner TH in the pouch member 32 may be detected by a full level detection sensor (piezoelectric sensor) suspended inward from the ceiling portion of the cover member 31 (as illustrated in FIG. 4B, the detection is performed before the closed space of the pouch member 32 is formed).

Referring to FIG. 4C, in the second embodiment, a plate member 35 (flat plate) is bonded to the pouch member 32 at a position to be the bottom when the pouch member 32 is turned inside out for collecting the waste toner TH. The plate member 35 is for maintaining the shape of the bottom.

By disposing such a plate member 35, the pouch member 32, which has the closed space formed by the thermal welding and functions as the waste toner collecting unit, maintains its shape in a state that it is housed in the cover member 31, without elongating downward from the thermally welded portion as a supporting portion, even after the toner container 30 is removed from the hopper unit 110 as illustrated in FIG. 4D.

As explained above, similarly to the first embodiment, the toner container 30 according to the second embodiment is configured to collect the waste toner TH after the new toner T is discharged from the pouch member 32 by disposing the pouch member 32 containing the new toner T therein inside the cover member 31 and reversing the pouch member 32 after the new toner T is discharged therefrom. Thereby, it is possible to utilize the space of the toner container 30 effectively.

Third Embodiment

Next, a third embodiment will be described in detail with reference to FIGS. 5A to 6.

Figure 5A:
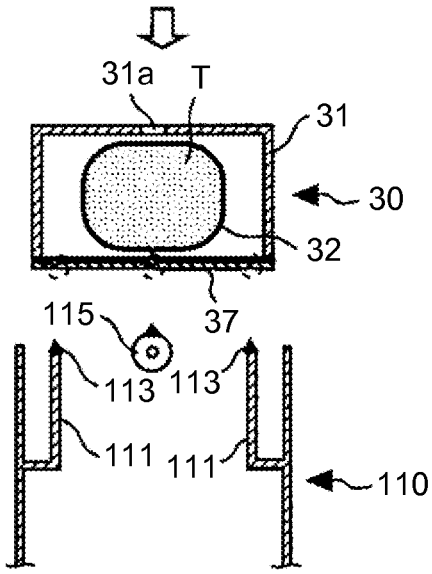
FIGS. 5A to 5C are diagrams illustrating an operation of inserting a toner container according to a third embodiment.
Figure 5B:
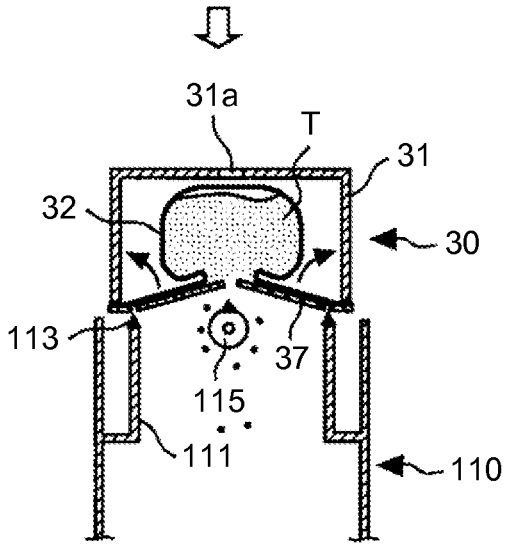
Figure 5C:
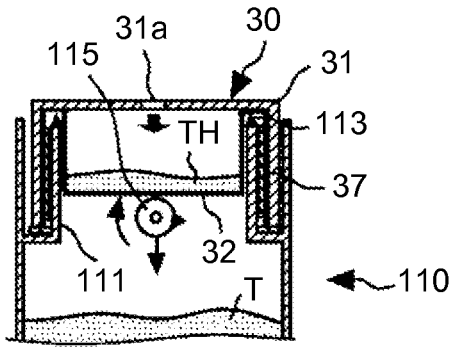

FIGS. 5A to 5C are diagrams illustrating an operation of inserting (installing) a toner container 30 according to the third embodiment. FIG. 6 is a diagram illustrating a toner container 30 according to a modification of this embodiment.

The toner container 30 according to the third embodiment mainly differs from the toner container according to the first embodiment in that an openable cover 37 covering the opening of the cover member 31 is provided.

Referring to FIG. 5A, similarly to the first embodiment, the toner container 30 according to the third embodiment is provided with a pouch member 32 and a cover member 31. Similarly to the first embodiment, the pouch member 32 contains the new toner T in a closed space formed by sealing the joint portion 32*a*. The cover member 31 is for covering the outside of the pouch member 32, and has the inlet 31*a* at the ceiling portion thereof. Also in the third embodiment, the pouch member 32 is fixed to the cover member 31 at the boundary portions 32*b*. Specifically, the boundary portion 32*b* of the pouch member 32 is fixed at the periphery of the opening of the cover member 31. And, the pouch member 32 can be reversed (turned inside out) to also act as a waste toner collecting unit.

Different from the first embodiment, the toner container 30 according to the third embodiment is provided with the openable cover 37 that covers the opening formed at a lower part of the cover member 31. By disposing the openable cover 37 for covering the opening of the cover member 31, it is possible to reinforce the strength of the pouch member 32 in a state that the new toner T is contained therein. That is, the portion in which the new toner T is contained is not only sustained at portions of the pouch member 32 fixed to the opening of the cover member 31 but also sustained by the openable cover 37.

Notched portions (which are thinner than the other portions) are formed at the center and in the vicinity of both ends of the openable cover 37.

A rotating member 115 having a sharp portion is provided at the center of the hopper unit 110. The rotating member 115 is configured to be rotated in the clockwise and counterclockwise direction of FIGS. 5A to 5C and moved in the vertical direction of FIGS. 5A to 5C by a moving mechanism (not illustrated).

At the leading ends of the protruding portions 111 of the hopper unit 110, there are formed the engaging portions 113 that are sharply tapered to the top and slanted downward as appropriate.

As the toner container 30 is inserted into the hopper unit 110 (the apparatus body 1), the openable cover 37 opens the opening of the cover member 31. Specifically, the sharp portion of the rotating member 115 engages the notched portion formed at the center portion of the openable cover 37 so that the openable cover 37 is split at the notched portion, cooperatively with the installation operation of the toner container 30 into the hopper unit 110. Thus, the opening of the cover member 31 is opened.

Incidentally, a part of the openable cover 37 (a part where the notch is not formed) is adhered or bonded to the pouch member 32 in order to prevent the split openable cover 37 from falling down into the hopper unit 110.

Next, an operation of inserting the toner container 30 into the hopper unit 110 (image forming apparatus body 1) will be described in detail with reference to FIGS. 5A to 5C.

First, as illustrated in FIG. 5A, the installation of the toner container in a state that the new toner T is contained in the pouch member 32 is started toward the hopper unit 110 of the apparatus body 1 from the upper side (the movement in the direction illustrated by a white arrow in figure).

Then, as illustrated in FIG. 5B, as the installation of the toner container 30 proceeds downward, the sharp portion of the rotating member 115 engages the notched portion formed at the center portion of the openable cover 37 so that the openable cover 37 is split at the notched portion. At this time, the joint portion 32*a* is also unsealed to discharge the new toner T from the pouch member 32 to the hopper unit 110. At timing slightly later from when the joint portion 32*a* is unsealed, the leading ends of the engaging portions 113 engage the notches at both sides of the openable cover 37 to further split the openable cover 37 at the side notches. At that time, the split openable cover 37 is guided in between the protruding portions and the cover member 31 along the slant surfaces of the engaging portions 113. After the openable cover 37 is split by the rotating member 115, the rotating member 115 is moved downward by the moving mechanism (not illustrated).

Then, as illustrated in FIG. 5C, the operation of inserting the toner container 30 downward is further progressed and the position of the toner container 30 relative to the hopper unit 110 is settled. Then, the pouch member 32 is turned inside out and the waste toner TH flows into the pouch member 32. In this case, the rotating member 115 is moved down by the moving mechanism (not illustrated) such that the sharp leading end thereof does not interfere with the reversed pouch member 32 and is rotated in a predetermined direction (the rotating member 115 is moved and rotated in the direction of an arrow in FIG. 5C). In addition, the split openable cover 37 is accommodated in between the protruding portions 111 and the outer wall of the cover member 31.

Due to the configuration, as illustrated in FIG. 5C, in which the split openable cover 37 is accommodated between the protruding portions and the outer wall of the cover member 31 so that the accommodated cover 37 tightly attached to the outer wall of the cover member 31, the pouch member 32, which is reversed to function as the waste toner collecting unit, can maintain its shape in a state that it is housed in the cover member 31 without thermally welding the pouch member 32 by the heater 112 as in the first embodiment, even after the pouch member 32 is removed from the hopper unit 110 (the apparatus body 1) so that the pressing force by the protruding portions 111 is released.

In the third embodiment, in the new toner container 30, the openable cover 37 having the notched portions formed therein covers the opening of the cover member 31.

Figure 6:
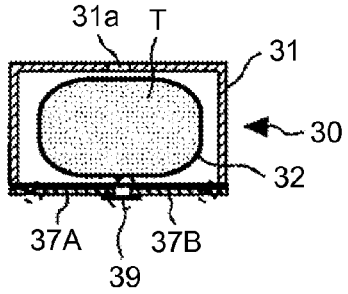
FIG. 6 is a diagram illustrating a toner container according to another embodiment.

Alternatively, as illustrated in FIG. 6, an openable cover may be formed such that it covers the opening of the cover member 31 with two plate members 37A and 37B held by a sealing material 39. In this case, when the toner container 30 is inserted into the hopper unit 110, the sealing material 39 is taken off to separate the two plate members 37A and 37B. In this way, similarly to the third embodiment, the opening of the cover member 31 can be opened.

Similarly to the third embodiment, in order to take off the sealing material 39, the rotating member 115 (sharp portion) may be used to cut the sealing material 39 with the insertion of the toner container 30, or the sealing material 39 may be manually taken off during the insertion of the toner container 30 into the hopper unit 110.

As described above, similarly to each of the above-described embodiments, in the toner container 30 according to the third embodiment, the pouch member 32 having a new toner T stored therein is provided at the cover member 31 and the pouch member 32 is turned inside out to collect the waste toner TH after the new toner T is discharged. In this way, the space of the toner container 30 can be used effectively.

Fourth Embodiment

Next, a fourth embodiment of the invention will be described in detail with reference to FIGS. 7A to 9B.

Figure 8:
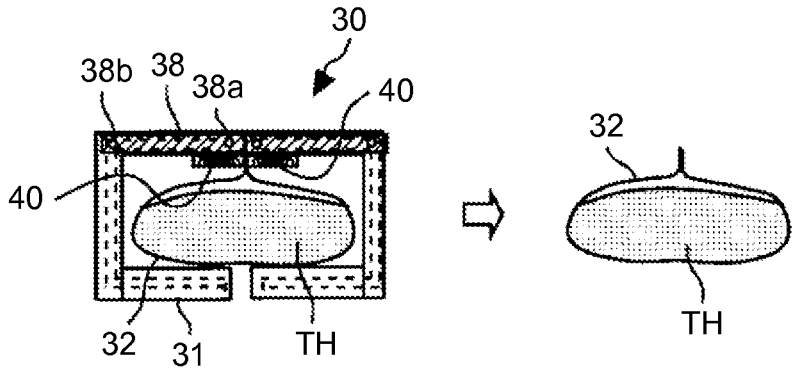
FIG. 8 is a diagram illustrating a toner container according to another embodiment.
Figure 9A:
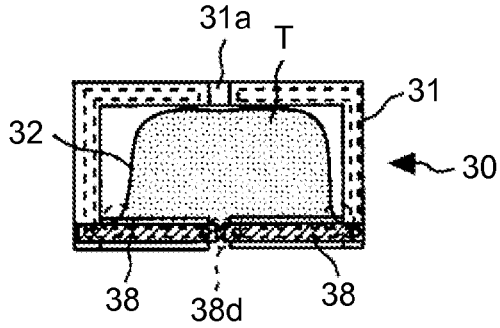
FIGS. 9A and 9B are diagrams illustrating a toner container according to still another embodiment.
Figure 9B:
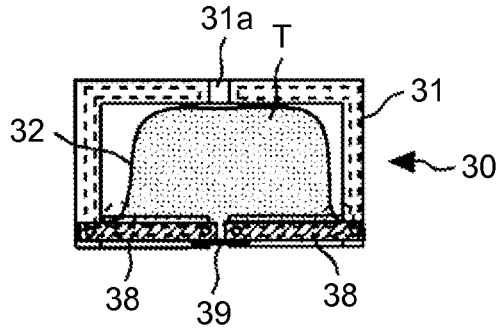

FIGS. 7A to 7D are diagrams illustrating an operation of inserting or removing a toner container 30 according to the fourth embodiment. FIG. 8 is a diagram illustrating a toner container 30 according to a modification of this embodiment. FIGS. 9A and 9B are diagrams illustrating a toner container 30 according to still another modification of this embodiment.

The toner container 30 according to the fourth embodiment mainly differs from the toner container according to the first embodiment in that a shutter member 38 is provided which moves along a guide portion 31*c* of the cover member 31 in operative association with the insertion of the toner container into the apparatus body.

Figure 7A:
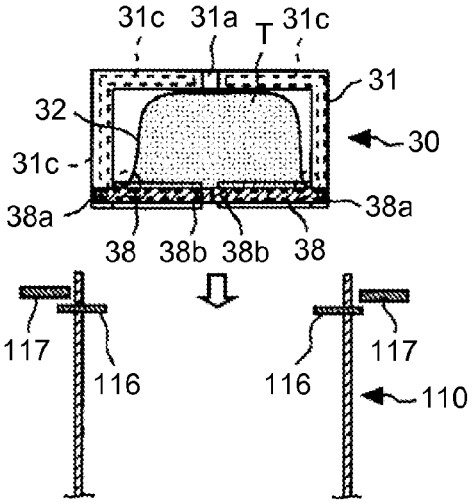
FIGS. 7A to 7D are diagrams illustrating an operation of inserting or removing a toner container according to a fourth embodiment.

Referring to FIG. 7A, similarly to the toner container according to the first embodiment, the toner container 30 according to the fourth embodiment includes a pouch member 32 having a new toner T stored therein and the cover member 31 in which an inlet 31*a* is formed in a ceiling portion covering the outside of the pouch member 32. In addition, in the fourth embodiment, after the pouch member 32 is turned inside out (reversed), it functions as a waste toner collecting pouch.

The toner container 30 according to the fourth embodiment differs from the toner container according to the first embodiment in that a shutter member 38 which covers an opening formed at a lower part of the cover member 31 is provided. As such, when the shutter member 38 covering the opening of the cover member 31 is provided, the strength of the pouch member 32 having the new toner T stored therein can be reinforced. That is, a portion having the new toner T stored therein is not supported only by a portion of the pouch member 32 which is provided so as to extend at the position of the opening, but it can be reinforced and supported by the shutter member 38.

The shutter member 38 is a plate made of a resin material having a certain mechanical strength and includes a first shaft portion 38*a* and a second shaft portion 38*b* at both ends in the width direction (a direction vertical to the plane of figures. thereof. The first shaft portion 38*a* and the second shaft portion 38*b* engage guide portions 31*c* (through holes) formed in side plates which are provided at both ends of the cover member 31 in the width direction so as to have the shutter member 38 interposed therebetween. In addition, the first shaft portion 38*a* and the second shaft portion 38*b* pass through the guide portions 31*c* and portions of the first shaft portion 38*a* and the second shaft portion 38*b* are exposed to the outside of the cover member 31 (the exposed portions are pressed against abutting members 116 or movable members 117 which will be described below).

In the fourth embodiment, in the pouch member 32, a boundary portion 32*b* (a portion surrounded by a dashed line in FIG. 7A) is fixed to a portion (a portion corresponding to the circumference of the opening) of the shutter member 38 by, for example, thermal welding with the opening being closed. The new toner T is stored in a closed space formed by the pouch member 32 and the shutter member 38 when the opening of the cover member 31 is sealed.

A pair of the shutter members 38 to which the boundary portion 32*b* of the pouch member 32 is fixed is moved with the movement of the first shaft portion 38*a* and the second shaft portion 38*b* along the guide portions 31*c* formed in a U shape in the cover member 31. Then, the closed opening is exposed and the new toner T stored in the pouch member 32 is discharged. In addition, the inside of the pouch member 32 which is turned inside out faces the inlet 31*a*.

Specifically, a portion (first shaft portion 38*a*) of the shutter member 38 is pressed against the abutting member 116 of the hopper unit 110 in operative association with the insertion of the toner container 30 into the hopper unit 110 (apparatus body 1), and the shutter member 38 is moved along the guide portion 31*c*. In addition, after the amount of waste toner TH collected in the pouch member 32 reaches a predetermined value, a portion (first shaft portion 38*a*) of the shutter member 38 is pressed against the movable member 117 provided at the hopper unit 110 and is then moved along the guide portion 31*c*. In this way, a closed space in which the waste toner TH is collected is formed in the pouch member 32 (state illustrated in FIG. 7D).

Next, an operation of inserting or removing the toner container 30 into the hopper unit 110 (image forming apparatus body 1) will be described in detail with reference to FIGS. 7A to 7D.

First, as illustrated in FIG. 7A, an operation of inserting the toner container 30 in which the new toner T is stored in the pouch member 32 into the hopper unit 110 of the apparatus body 1 from the upper side starts (the toner container 30 is moved in the direction of a white arrow). In this case, the shutter member 38 is disposed at the position covering the opening of the cover member 31.

Figure 7B:
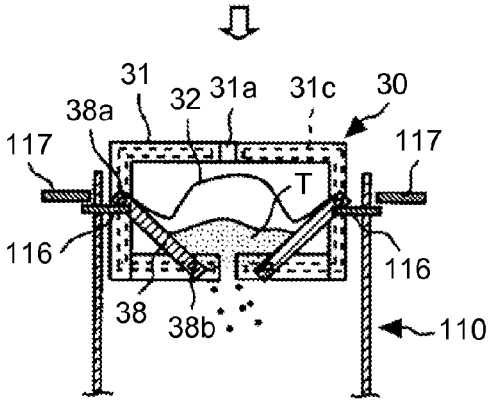

Then, as illustrated in FIG. 7B, the operation of inserting the toner container 30 downward is progressed. When the first shaft portion 38*a* of the shutter member 38 comes into contact with the abutting member 116, the first shaft portion 38*a* is pressed by the abutting member 116 with the movement of the toner container 30 in the downward direction and the shutter member 38 is moved along the guide portion 31*c*. In this way, the opening of the cover member 31 is opened and the new toner T is discharged from the pouch member 32 to the hopper unit 110.

Figure 7C:
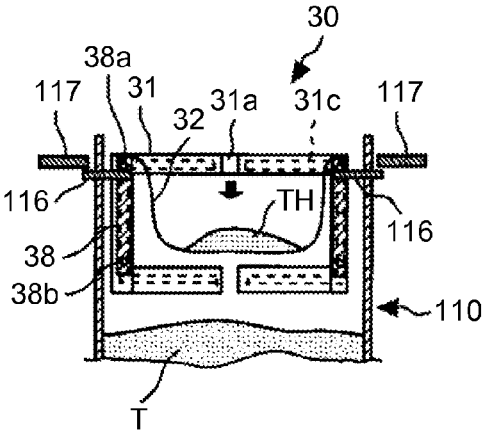

Then, as illustrated in FIG. 7C, the operation of inserting the toner container 30 downward is further progressed. The toner container 30 is locked by a locking portion (not illustrated) formed at the hopper unit 110, the position of the toner container 30 relative to the hopper unit 110 is settled, and the waste toner TH flows into the reversed pouch member 32 from the inlet 31*a*. In this case, the shutter member 38 rises in the vertical direction.

Figure 7D:
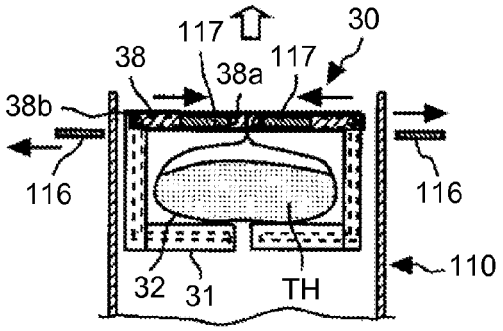

Then, as illustrated in FIG. 7D, when the amount of waste toner TH collected in the toner container 30 (pouch member 32) is equal to or more than a predetermined value (a full state or a near-full state), the abutting member 116 is horizontally moved by a moving mechanism (not illustrated) in a direction in which it is separated from the toner container 30 so as not to interfere with the second shaft portion 38*b*, and the movable member 117 at the retreated position is horizontally moved to the center while pressing the first shaft portion 38*a* (movement in the direction of an arrow in FIG. 7D). In this way, as illustrated in FIG. 7D, the shutter member 38 is moved to the position of the ceiling portion of the cover member 31 along the guide portion 31*c*. In this case, the boundary portion 32*b* of the pouch member 32 is interposed and narrowed between the two shutter members 38 which contact each other at the position of the ceiling portion, and a closed space in which the waste toner TH is collected is formed.

Then, the toner container 30 in the state illustrated in FIG. 7D is moved in the direction of a white arrow and is separated from the hopper unit 110 (apparatus body 1). In this case, the movable member 117 is moved to a position (position illustrated in FIG. 7A) where it does not hinder the removal of the toner container 30.

In the fourth embodiment, the two shutter members 38 are used to open the opening of the cover member 31. However, one shutter member may be used to open the opening of the cover member 31.

The full state of the waste toner TH in the pouch member 32 may be detected by a full level detection sensor (piezoelectric sensor) which is suspended from the ceiling portion of the cover member 31 to the inside thereof.

In the fourth embodiment, as illustrated in FIG. 8, a heater 40 serving as a heating unit may be provided at a portion (the end of the first shaft portion 38*a*) of the shutter member 38. In the state that the closed space in which the waste toner TH is collected is formed in the pouch member 32 by the movement of the shutter member 38, the narrowed portion of the pouch member 32 is thermally welded by the heater 40 (heating unit). In this way, as illustrated in FIG. 8, the pouch member 32 can be taken out which has an independent closed space from the toner container 30 removed from the apparatus body 1. Therefore, operability can be improved when the pouch member 32 having the waste toner TH stored therein is taken out from the toner container 30.

It is preferable that the heater 40 be connected to a power supply unit (not illustrated) provided at the hopper unit 110 in operative association with the insertion of the toner container 30 into the hopper unit 110. The heater 40 is supplied with power from the power supply unit at the above-mentioned timing and performs the above-mentioned thermal welding.

In the fourth embodiment, as illustrated in FIG. 9A, a notched portion 38*d* may be formed at a portion of the shutter member 38 with the opening being closed. That is, the shutter member 38 is one shutter member having the notched portion 38*d* formed at the center thereof with the opening of the cover member 31 being closed. A sharp portion (see the rotating member 115 according to the third embodiment) of the hopper unit 110 engages the notched portion in operative association with the insertion of the toner container 30 into the hopper unit 110 and the shutter member 38 is split into two shutter members 38 at the position of the notched portion 38*d*. The two split shutter members 38 are moved along the guide portions 31*c* described with reference to FIGS. 7A to 7D to expose the opening. According to this structure, the same effect as that in the fourth embodiment may be obtained.

As illustrated in FIG. 9B, two shutter members 38 held by a sealing material 39 with the opening being closed may be used as the shutter member. When the toner container 30 is inserted into the hopper unit 110, the sealing material 39 is taken off to separate the two shutter members 38 and the two separated shutter members 38 are moved along the guide portions 31*c* described with reference to FIGS. 7A to 7D to open the opening. According to this structure, the same effect as that in the fourth embodiment can be obtained. As a method of taking off the sealing material 39, the same method as that described with reference to FIG. 6 in the third embodiment may be used.

As described above, in the toner container 30 according to the fourth embodiment, similarly to each of the above-described embodiments, the pouch member 32 having a new toner T stored therein is provided in the cover member 31 and the pouch member 32 is turned inside out to collect the waste toner TH after the new toner T is discharged. In this way, the space of the toner container 30 can be effectively used.

In each of the above-described embodiments, the invention is applied to the toner container 30 that supplies the toner T to the single-component developing device 13 (developing device storing only the toner T as a developer).

However, the invention may be applied to a toner container 30 that supplies the toner T to a two-component developing device 13 (developing device storing a two-component developer including toner and a carrier). In this case, a new toner T may be supplied from the toner container 30 to the developing device 13 (hopper unit 110) or a two-component developer (toner and a carrier) may be supplied from the toner container 30 (developer container) to the developing device 13. In particular, when the two-component developer is supplied from the toner container 30 (developer container) to the developing device 13, a unit that appropriately discharges an excess developer from the developing device 13 is provided and the pouch member 32 of the toner container 30 is filled with a new toner T and a new carrier.

According to this structure, the same effect as that in each of the above-described embodiments can be obtained.

The invention is not limited to the above-described embodiments, but the above-described embodiments may be appropriately changed in various ways without departing from the scope and spirit of the invention. In addition, for example, the number of components and the position and shape of the components are not limited to the above-described embodiments, but may be appropriately changed so as to be suitable to implement the invention.

According to the invention, the pouch member having a new toner stored therein is provided in the cover member and, after the new toner is discharged, the pouch member is turned inside out to collect the waste toner. In this way, a toner container and an image forming apparatus capable of effectively using a space may be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner container that is removably installed into an image forming apparatus body, the toner container comprising:

a pouch member that contains a new toner therein and can be turned inside out; and a cover member that covers an outside of the pouch member and includes an inlet through which a waste toner flows in, the inlet being formed opposite to a side of the cover member from which the new toner contained in the pouch member is discharged, wherein after the new toner contained in the pouch member is discharged, the pouch member is turned inside out, and the waste toner flows from the inlet into the pouch member.

2. The toner container according to claim 1, wherein the new toner contained in the pouch member is discharged and the pouch member is turned inside out, in operative association with the installation of the toner container into the image forming apparatus body.

3. The toner container according to claim 1, wherein the cover member is a box-shaped member having an opening, a boundary portion between the inside and the outside of the pouch member is fixed to a circumference of the opening of the cover member, and the pouch member includes a joint portion that is sealed at a center portion of the opening spaced from the boundary portion to form a closed space in which the new toner is contained.

4. The toner container according to claim 3, wherein in operative association with the installation of the toner container into the image forming apparatus body, a portion of the pouch member between the boundary portion and the joint portion is pressed by a protruding portion of the image forming apparatus body, the joint portion is unsealed, the new toner contained in the closed space is discharged, and the inside of the pouch member that is turned inside out faces the inlet.

5. The toner container according to claim 4, wherein the cover member includes an inner wall extending toward the opening from a ceiling portion of the cover member to sandwich the protruding portion of the image forming apparatus body between an outer wall and the inner wall of the cover member when the toner container is installed into the cover member, the inner wall defining a shape of the pouch member after the pouch member is turned inside out.

6. The toner container according to claim 4, wherein a heating unit is disposed at a leading end of the protruding portion of the image forming apparatus body, and the pouch member that is turned inside out such that the inside thereof faces the inlet is thermally welded to the cover member by the heating unit.

7. The toner container according to claim 6, wherein the pouch member is thermally welded to the cover member by the heating unit at a timing when the installation of the toner container into the image forming apparatus body is completed or at a timing when an amount of waste toner collected in the pouch member reaches a predetermined value.

8. The toner container according to claim 4, wherein a heating unit is disposed at a leading end of the protruding portion of the image forming apparatus body and the leading end of the protruding portion is capable of moving toward the inside of the cover member, after a predetermined amount of waste toner is collected in the pouch member that is turned inside out such that the inside thereof faces the inlet, the protruding portion moves to form a closed space in which the waste toner is collected, and the closed space is thermally welded by the heating unit.

9. The toner container according to of claim 3, further comprising:

an openable cover that covers the opening of the cover member and opens the opening when the toner container is installed into the image forming apparatus body.

10. The toner container according to claim 9, wherein a notched portion is formed at a portion of the openable cover, and in operative association with the installation of the toner container into the image forming apparatus body, a sharp portion of the image forming apparatus body engages the notched portion to open the opening by splitting the openable cover at the position of the notched portion.

11. The toner container according to claim 9, wherein the openable cover is configured to close the opening by two plate members sealed by a sealing material, and when the toner container is installed into the image forming apparatus body, the opening is opened by removing the sealing material to split the two plate members.

12. The toner container according to claim 1, wherein the cover member is a box-shaped member having an opening, the cover member includes a shutter member to which a boundary portion between the inside and the outside of the pouch member is fixed, the shutter member moving along a guide portion formed in the cover member, the shutter member moves along the guide portion to open the opening, discharge the new toner contained in the pouch member, and turn inside out the pouch member such that the inside thereof faces the inlet.

13. The toner container according to claim 12, wherein in operative association with the installation of the toner container into the image forming apparatus body, a portion of the shutter member is pressed by a abutting member of the image forming apparatus body to move the shutter member along the guide portion.

14. The toner container according to claim 12, wherein after an amount of waste toner collected in the pouch member reaches a predetermined value, a movable member disposed at the image forming apparatus body presses the shutter member to further move the shutter member along the guide portion so that a closed space of the pouch member is formed in which the waste toner is collected.

15. The toner container according to claim 14, wherein a heating unit is disposed at the shutter member and the pouch member is thermally welded by the heating unit in a state that the closed space having the waste toner collected therein is formed.

16. The toner container according to claim 12, wherein the shutter member has a notched portion when the opening is closed, and in operative association with the installation of the toner container into the image forming apparatus body, a sharp portion of the image forming apparatus body engages the notched portion to open the opening by splitting the shutter member into two shutter members at the position of the notched portion, and moving each of the two shutter members along the guide portion.

17. The toner container according to claim 12, wherein the shutter member comprises two shutter members sealed by a sealing material to close the opening, and in operative association with the installation of the toner container into the image forming apparatus body, the sealing material is removed to open the opening by splitting the two shutter members, and moving each of the two shutter members along the guide portion.

18. The toner container according to claim 1, wherein a plate member is disposed at a position of the pouch member that is to be a bottom portion when the pouch member is turned inside out to collect the waste toner, for defining a shape of the bottom portion.

19. An image forming apparatus comprising a toner container that is removably installed into an image forming apparatus body, the toner container including:

a pouch member that contains a new toner therein and can be turned inside out; and a cover member that covers an outside of the pouch member and includes an inlet through which a waste toner flows in, the inlet being formed opposite to a side of the cover member from which the new toner contained in the pouch member is discharged, wherein after the new toner contained in the pouch member is discharged, the pouch member is turned inside out, and the waste toner flows from the inlet into the pouch member.

* * * * *